United States Patent [19]

Gomez et al.

[11] Patent Number: 5,074,552

[45] Date of Patent: Dec. 24, 1991

[54] BASKETBALL-TYPE AMUSEMENT DEVICE

[75] Inventors: George A. Gomez, Evanston; Thomas M. Kopera, Villa Park; John C. Kubik, Carol Stream, all of Ill.

[73] Assignee: Grand Products, Inc., Bensenville, Ill.

[21] Appl. No.: 581,010

[22] Filed: Sep. 12, 1990

[51] Int. Cl.[5] ..... A63B 63/08

[52] U.S. Cl. ..... 273/1.5 A; 273/402; 273/406

[58] Field of Search ..... 273/1.5 R, 1.5 A, 368, 273/406, 396–402

[56] References Cited

U.S. PATENT DOCUMENTS

| | | | |
|---|---|---|---|
| 1,924,757 | 8/1933 | Shisoff | 273/397 |
| 2,886,321 | 5/1959 | Tarte, Jr. | 273/368 |
| 2,893,734 | 7/1959 | Tarte, Jr. | 273/1.5 R X |
| 4,202,543 | 5/1980 | Collins | 273/1.5 R X |
| 4,239,214 | 12/1980 | Brenner | 273/1.5 R |
| 4,805,917 | 2/1989 | Cochran et al. | 273/397 |

*Primary Examiner*—Paul E. Shapiro

*Attorney, Agent, or Firm*—Wallenstein, Wagner & Hattis, Ltd.

[57] ABSTRACT

A basketball-type game apparatus has a hoop mounted to a backboard, the backboard being mounted for rotation by a rotary drive mechanism about an axis over a range of positions to present the thrower with a variety of angles from which to make his throw. The backboard is offset from a rotary drive system to carry the backboard and hoop through a horizontally disposed arc. Confining walls are provided in the form of an open front structure with the open-front defining the throwing position. A tilted floor in the form of a tray carries the supporting structure for the backboard and hoop, and returns the ball to the throwing position after each throw.

15 Claims, 3 Drawing Sheets

BASKETBALL-TYPE AMUSEMENT DEVICE

DESCRIPTION

1. Technical Field

The technical field of the invention is in games involving human skill.

2. Summary of the Invention

According to the invention, a basketball-type game apparatus has a basketball-type hoop mounted to a backboard with the backboard in turn mounted for rotation about a vertical axis. The game is programmed to present the thrower with a variety of different backboard angles corresponding to corner shots, key shots, and side-of-key shots. In the preferred form of the invention the hoop and backboard assembly is rotated by motor drive means, and the backboard is mounted to an offset arm to be driven by the motor drive means to be driven through a horizontal arc and arrestable at any position therealong. The hoop and backboard assembly may be rotated, if desired, through a complete 360 degree arc, thereby providing a range of positions in which the backboard generally faces away from the thrower to allow for over-the-backboard shots (super shots) if desired. An enclosure or wall means surrounds the rear and sides of the movable hoop and backboard assembly so as to confine the ball after it is thrown and defines a throwing position or station at the open end. A slanted floor under the basket is provided to return the ball to the throwing position. The motor drive may optionally be randomly driven to an unpredictable position for each throw, thereby introducing an element of chance if desired. In the alternative, the player may select the shot he desires. Since the offset arm is relatively short, the total floor space occupied by the entire game assembly is relatively small, rendering the game assembly particularly suitably for hobby rooms, arcades, bars and similar installations. The offset arm may optionally be dispensed with, causing the axis of rotation to lie generally proximate to the plane of the backboard thereby further minimizing space if desired.

Other advantages and aspects of the invention will become apparent upon making reference to the specification, claims, and drawings to follow.

DESCRIPTION OF THE INVENTION

Figure 1:
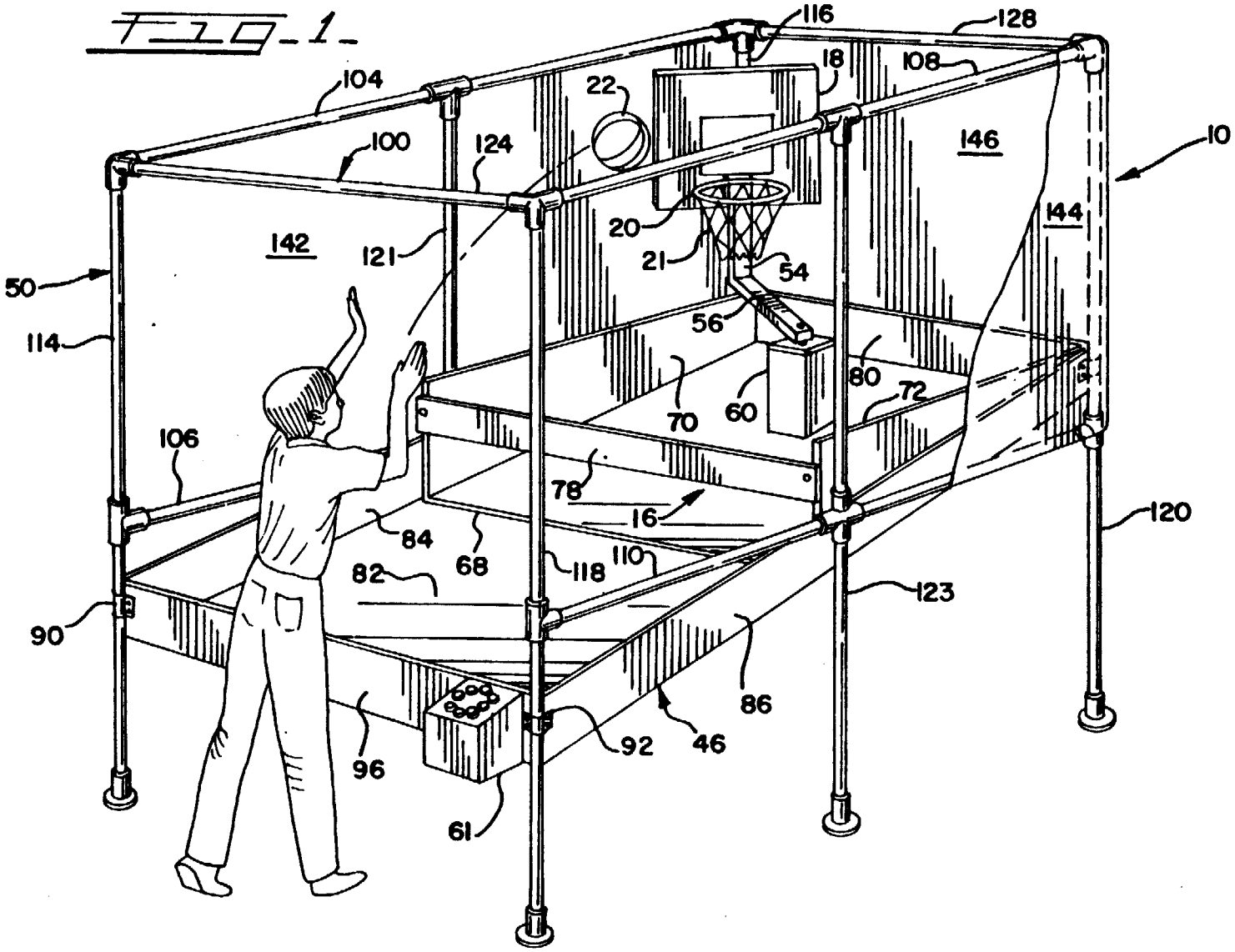
FIG. 1 is an isometric partially cutaway view of a basketball-type amusement device having a movable backboard and hoop.
Figure 2:
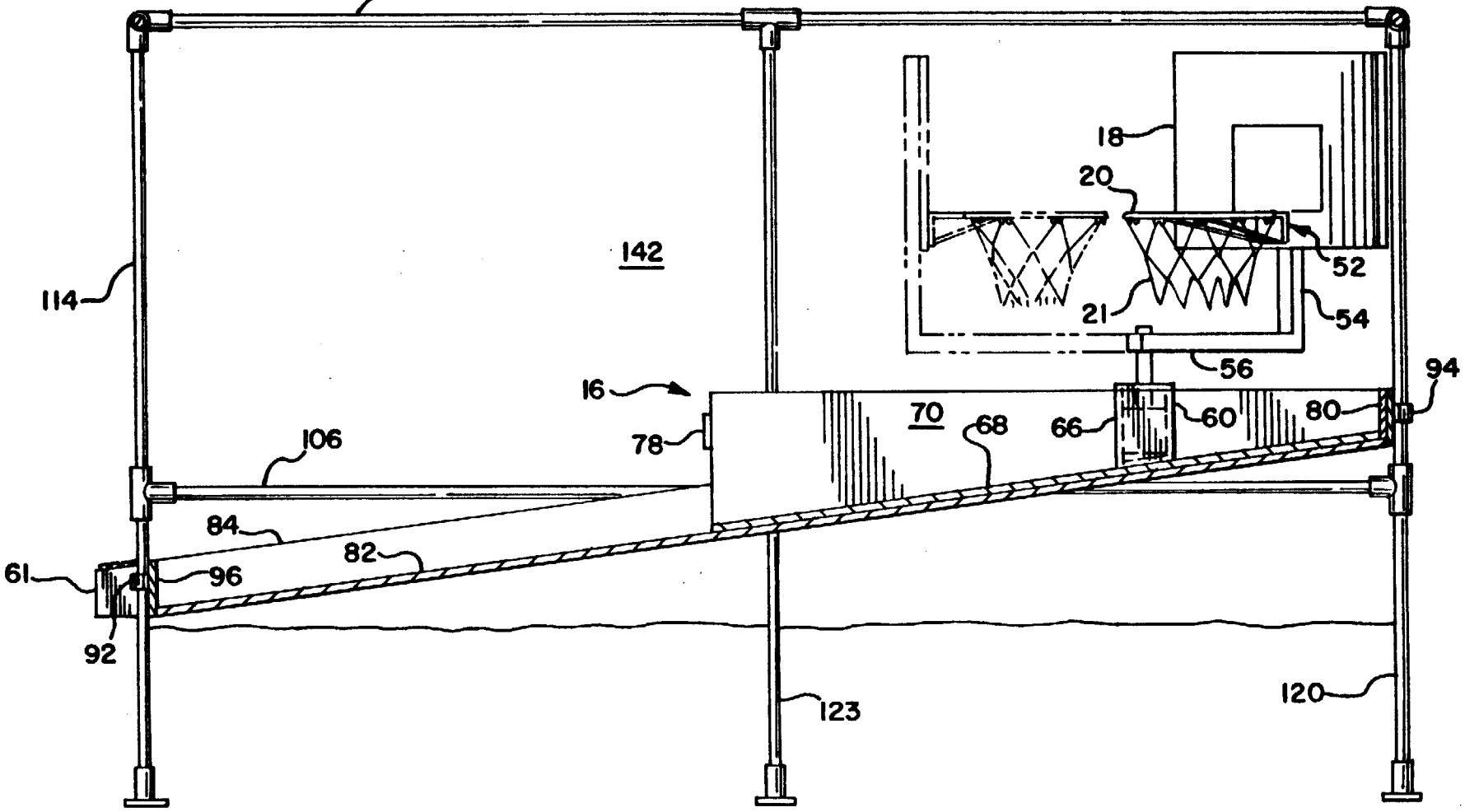
FIG. 2 is a cutaway side view of the system shown in FIG. 1.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 4:
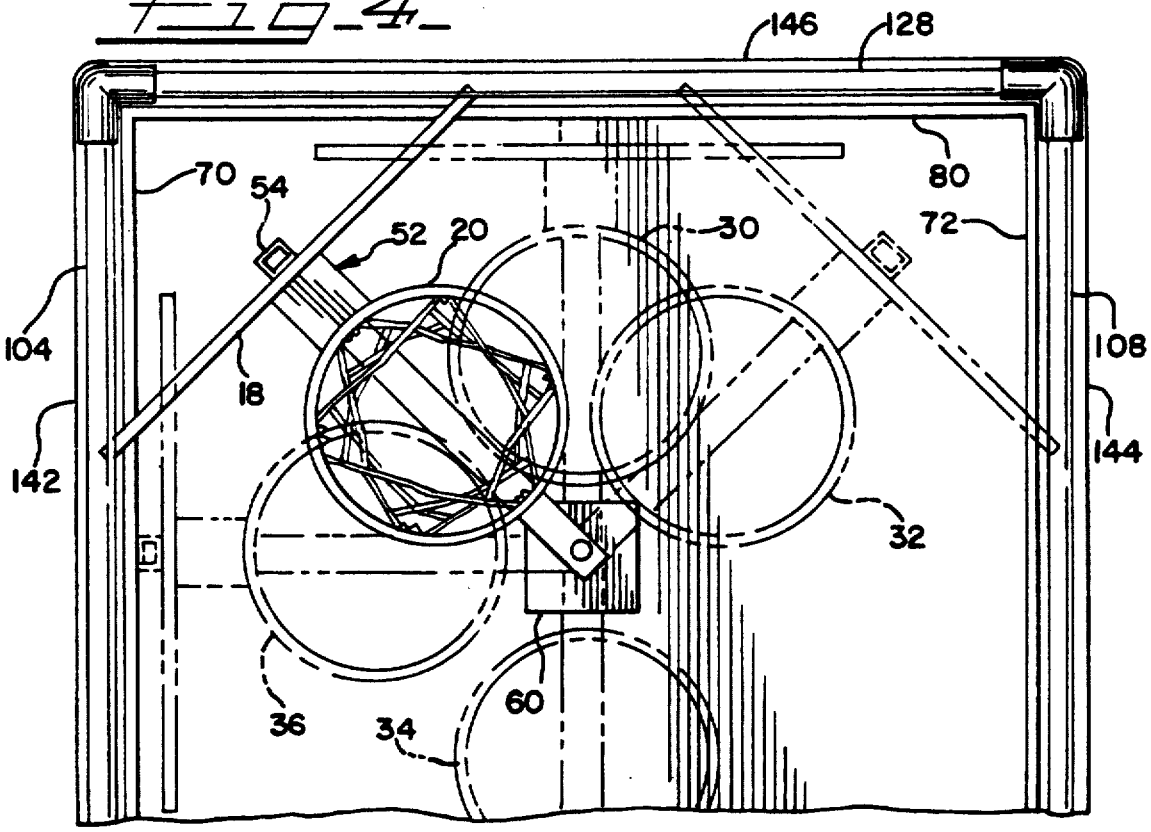
FIG. 4 is a top view of the apparatus as shown in FIG. 1, showing alternate positions of the backboard and basket in dotted outline.

Referring now to the drawings, a basketball-type game assembly 10 includes a movable hoop assembly 16 having a pivotally mounted backboard 18, basketball hoop 20, and basket 21. The backboard 18 and hoop 20 may, as is shown in FIG. 4, be rotated over a range of positions as indicated by the dotted outlines 30,32,34,36 shown in FIG. 4. Such positions as that shown by the dotted outlines 34 place the backboard 18 generally facing away from the thrower to allow for over-the-backboard shots (super shots) which may be specially selected if desired and the height of the ceiling permits such a shot. The movable hoop assembly 16 is mounted above a sloping tray assembly 46 which returns the ball 22 to the thrower. Confining walls are formed by a frame and shroud assembly 50 for confining the ball during play.

Figure 3:
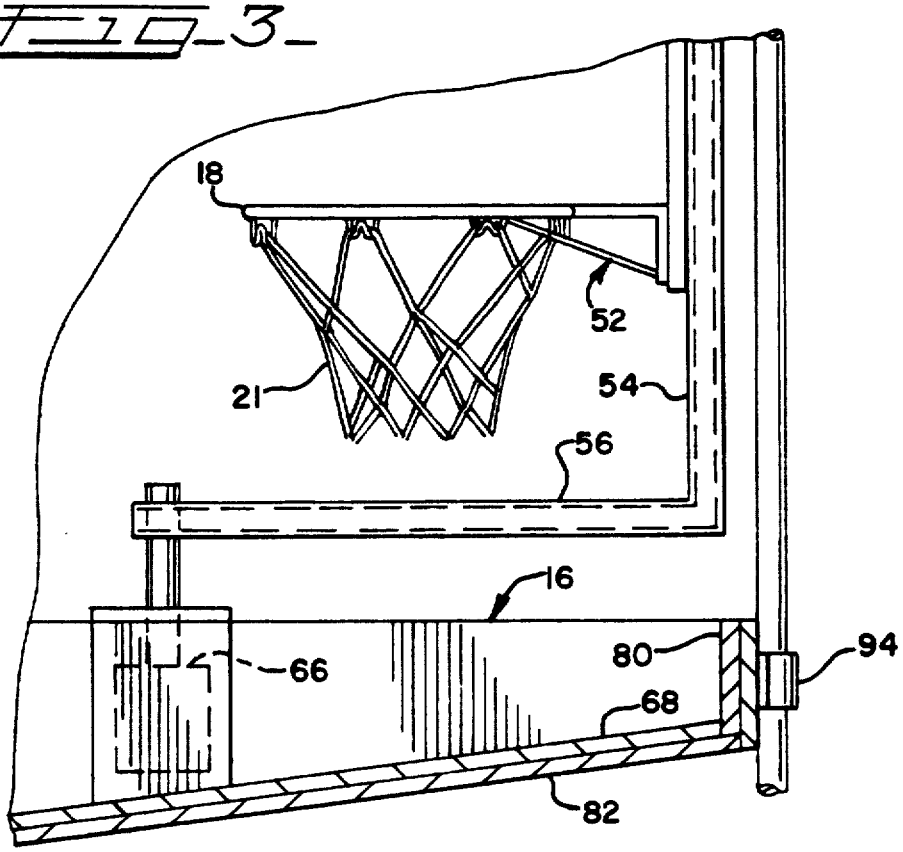
FIG. 3 is a side elevational view of portions of the system shown in FIGS. 1 and 2.

In more detail, and considering first the movable hoop assembly 16, the hoop 20 is permanently affixed to the backboard 18 by a conventional hoop strut assembly 52. The backboard 18 is supported at the rear thereof by a vertically extending post 54, the post being secured at its lower end to an offset arm 56 (See in particular FIG. 3. The opposite end of the arm 56 is pivotally mounted (by means not shown) to a pedestal 60 having motor drive means 66 therein permitting remote control of the position of the backboard 18 by means of a remote control unit 61. The pedestal 60 is secured to a floor member 68. Side walls 70,72 extend upwardly from opposite sides of the floor member 68, the requisite integrity to the structure being provided by front and rear cross braces 78,80.

The movable hoop assembly 16 is placed upon a tray assembly 46 having a tray floor 82 bounded on either side by side walls 84,86. The tray assembly 46 is mounted to uprights 114, 116, 118, 120 by clamps (one not shown) 90, 92, 94 to be supported above the floor at a slant. The tray floor 82 thus angles downward towards the throwing position. An end wall 96 is provided to retain returned balls. The pedestal 60 is oriented with respect to the floor member 68 of the movable hoop assembly 16 so that the axis of rotation of the motor drive means 66 is vertical when the floor member 68 is placed upon the tray floor 82.

Partially enclosing the tray assembly 46 is the previously mentioned frame and shroud assembly 50. Lengthwise extending side wall support structures are formed by upper and lower side members 104,106,108,110 respectively joined at their ends to floor mounted uprights 114,116,118,120. Cross braces 124,128 add rigidity to the structure. Members 116, 120, 128 serve as a framework for the rear wall of the structure. Enclosure of the structure is secured by the emplacement of side panels 142,144 and an end panel 146. These panels 142,144,146 may either be of fabric stretched and affixed to the confronting frame members, or in the alternative may be fabricated from lightweight reasonably rigid material, such as compressed board, sheet plastic or similar materials.

Although the backboard 18 and hoop 20 are shown in the preferred embodiment of the invention as being mounted at the end of an offset arm 56 to be carried through an arc about the pivoting axis of the motor drive means 66, this arm may optionally be dispensed with and the vertical post 54 may be rotated about its own axis. Either version presents the backboard 18 at various angles to the thrower. The latter version has the advantage of conserving space. Additionally, if desired the motor drive 66 may be actuated to preposition the backboard 18 and hoop 20 at a new location randomly chosen each time the motor drive means is actuated, introducing an element of chance from one throw to the next if one or more throwers compete in a game. The position of the basket may be controlled by the player or randomly selected by a microprocessor after one or more shots depending on the player, or the processor may position the basket based upon a programmed pattern, moving the basket after each successful shot or after a predetermined amount of time. For example, in a game of "horse" the first player selects the position of the basket and shoots. If he makes the basket, the second player must make the basket also at the same location or he has a "horse" on him. Three horses constitute a game. Another game would consist of attempting to sequentially eliminate letters spelling a chosen name of the game, one letter at a time by completing shots. Other games may be played also.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. A hoop apparatus for practicing basketball-type shots by a user from a given throwing position comprising:

a basketball hoop;

a backboard;

a hoop mount mounting said hoop to lie generally horizontal;

a backboard mount mounting said backboard vertically and proximate to one side of said hoop, including a pivoting system allowing rotation of said backboard about a vertical axis through a range of angular positions to provide the user with a range of different presented backboard angles and distances as seen from said given throwing position, said vertical axis being so placed that said hoop is disposed between said axis and said backboard.

2. The apparatus of claim 1 wherein said back-board and said hoop are affixed to each other.

3. The apparatus of claim 2 wherein said pivoting system is configured to carry said hoop and said backboard through a circular arc having its plane parallel to the floor.

4. The apparatus of claim 3 wherein said pivoting system includes a generally horizontally extending arm affixed to said backboard at one arm end and a pivoting arm support mounting said arm for rotation about said vertical axis at the other arm end.

5. The apparatus of claim 4 including vertical walls for forming a partial enclosure about said backboard, said walls including a rear wall and a pair of sidewalls joining said rear wall on either side of said backboard and extending away from said rear wall to define said throwing position between the outer ends of said sidewalls, and a wall inclined to a horizontal plane extending from beneath said backboard forward towards said throwing position for returning a thrown ball to said throwing position.

6. The apparatus of claim 1, 2, 3, 4, or 5 wherein said backboard is planar and said hoop is circular.

7. The apparatus of claims 1, 2, 3, 4, or 5 including a motor drive system for rotatably driving said backboard through said range of angular positions to a plurality of stationary positions therealong.

8. The apparatus of claims 1 or 4 wherein said range of angular positions includes a range of positions wherein said backboard is interposable between said hoop and said given throwing position.

9. The apparatus of claims 1 or 4 wherein said range of angular positions is about 360 degrees.

10. A hoop apparatus for practicing basketball-type shots by a user from a given throwing position comprising:

a planar circular hoop;

a planar backboard mounted to said hoop perpendicularly to the plane of said hoop and proximate to one edge of said hoop;

a mounting system mounting said backboard to dispose the plane of said hoop horizontally, said mounting system including a generally horizontally extending arm affixed to said backboard at one arm end and a pivoting arm support supporting said arm for rotation about a vertical axis at the other arm end to carry said hoop and said backboard through a circular arc over a range of angular positions with said hoop disposed between said axis and said backboard to provide the user with a range of different presented backboard angles and distances as seen from said given throwing position.

11. The apparatus of claim 10 including vertical walls forming a partial enclosure about said backboard, and including a rear wall and a pair of sidewalls joining said rear wall on either side of said backboard and extending away from said rear wall to define said throwing position between the outer ends of said sidewalls, and inclined floor means extending from beneath said backboard forward towards said throwing position for returning a thrown ball to said throwing position the user.

12. The apparatus of claim 11 including a motor drive system for rotatably driving said arm through said range of angular positions to a plurality of stationary positions therealong.

13. The apparatus of claims 10, 11, or 12 wherein said range of angular positions includes a range of positions wherein said backboard is interposable between said hoop and said given throwing position.

14. The apparatus of claims 10, 11, or 12 wherein said range of angular positions is about 360 degrees.

15. The apparatus of claims 4 and 10 wherein said horizontally extending arm extends from said backboard below said hoop.

* * * * *